US012064081B2

(12) United States Patent
Ortmann

(10) Patent No.: US 12,064,081 B2
(45) Date of Patent: Aug. 20, 2024

(54) METHOD FOR ADJUSTING A PARAMETER RANGE ON A FLOOR TREATMENT DEVICE, AS WELL AS FLOOR TREATMENT DEVICE AND SYSTEM WITH A FLOOR TREATMENT DEVICE AND AN EXTERNAL TERMINAL

(71) Applicant: Vorwerk & Co. Interholding GmbH, Wuppertal (DE)

(72) Inventor: Roman Ortmann, Duisburg (DE)

(73) Assignee: Vorwerk & Co. Interholding GmbH, Wuppertal (DE)

( * ) Notice: Subject to any disclaimer, the term of this patent is extended or adjusted under 35 U.S.C. 154(b) by 100 days.

(21) Appl. No.: 17/828,114

(22) Filed: May 31, 2022

(65) Prior Publication Data

US 2023/0000300 A1 Jan. 5, 2023

(30) Foreign Application Priority Data

Jun. 1, 2021 (EP) ..... 21177078

(51) Int. Cl.
*A47L 9/28* (2006.01)
*A47L 5/28* (2006.01)

(52) U.S. Cl.
CPC ..... *A47L 9/2857* (2013.01); *A47L 5/28* (2013.01); *A47L 9/2805* (2013.01); *A47L 9/2826* (2013.01); *A47L 9/2831* (2013.01); *A47L 9/2842* (2013.01); *A47L 9/2847* (2013.01); *A47L 9/2852* (2013.01); *A47L 9/2894* (2013.01)

(58) Field of Classification Search
CPC ..... A47L 9/2857; A47L 5/28; A47L 9/2805; A47L 9/2826; A47L 9/2831; A47L 9/2842; A47L 9/2847; A47L 9/2852; A47L 9/2894
See application file for complete search history.

(56) References Cited

U.S. PATENT DOCUMENTS

2018/0360283 A1* 12/2018 Hackert ..... A47L 9/2805
2019/0204851 A1* 7/2019 Afrouzi ..... B25J 9/1664
2019/0365177 A1* 12/2019 Gordon ..... A47L 9/2847
2020/0154968 A1* 5/2020 Terry ..... A47L 9/2847
2020/0315418 A1* 10/2020 Howard ..... A47L 9/1409

* cited by examiner

*Primary Examiner* — Sharidan Carrillo
(74) *Attorney, Agent, or Firm* — Collard & Roe, P.C.

(57) ABSTRACT

A method for adjusting at least one parameter range of a device parameter of a floor treatment device for treating a surface. The parameter range is available on the floor treatment device and depends on a floor type of the surface to be treated. The parameter range comprises a defined scope of values of the device parameter selected by the user for the treatment of the surface. The user moves the floor treatment device over the surface to be treated during an adjustment process, wherein a limiting device parameter, which is dependent on the nature of the surface and upon its use for the treatment of the surface leads to a predefined fault, is automatically determined during the movement of the floor treatment device, and wherein the parameter range is automatically adjusted based on the determined limiting device parameter which defines a range end of the parameter range.

8 Claims, 4 Drawing Sheets

METHOD FOR ADJUSTING A PARAMETER RANGE ON A FLOOR TREATMENT DEVICE, AS WELL AS FLOOR TREATMENT DEVICE AND SYSTEM WITH A FLOOR TREATMENT DEVICE AND AN EXTERNAL TERMINAL

CROSS REFERENCE TO RELATED APPLICATIONS

Applicant claims priority under 35 U.S.C. § 119 of European Application No. 21177078.9 filed Jun. 1, 2021, the disclosure of which is incorporated by reference.

BACKGROUND OF THE INVENTION

1. Field of the Invention

The invention pertains to a method for adjusting at least one parameter range of a device parameter of a floor treatment device for treating a surface, wherein said parameter range is available on the floor treatment device and depends on a floor type of the surface to be treated, and wherein the parameter range comprises a defined scope of device parameter values that can be selected by the user for the treatment of the surface.

In addition, the invention pertains to a floor treatment device with a control unit designed for carrying out such a method, as well as to a system with a floor treatment device and a terminal that is external to the floor treatment device, wherein an application designed for controlling a method of the aforementioned type is installed on the external terminal.

2. Description of the Related Art

Methods of the aforementioned type are known from the prior art and usually carried out by a manufacturer of the floor treatment device in order to adjust defined parameter ranges for the operation of the floor treatment device for a surface treatment on the floor treatment device. In this case, suitable parameter ranges, within the parameter limits of which the user can adjust a device parameter of the floor treatment device for the treatment of the surface, are predefined for conventional household surfaces to be treated, particularly for the floor types installed on those surfaces such as carpeted floors, wooden floors, tiled floors, etc. For example, an adjustable device parameter may be a rotational speed of a rotating cleaning brush, a suction power of a fan of the floor treatment device, etc. The user can select the respective device parameter by means of an actuating element on the floor treatment device, e.g. by means of a rotary knob, a touchscreen, a sliding switch or the like. The actuating element can be adjusted between a minimum value and a maximum value for the respective device parameter as required. It is also known to provide multiple actuating elements of this type on a floor treatment device in order to enable the user to adjust different device parameters for the treatment of a surface.

Although the aforementioned methods and the corresponding floor treatment devices have proved to be successful in the prior art, they are only adapted to a limited number of different surfaces to be treated by the manufacturer such that there may also be surfaces, which do not fall in any of the pre-adjusted categories and therefore cannot be optimally treated. Alternatively, the user of the floor treatment device would have to manually try out device parameters without knowing which device parameters provide optimal prerequisites for the treatment of the respective floor surface.

SUMMARY OF THE INVENTION

Based on the above-described prior art, the invention therefore aims to enhance a method of the aforementioned type in such a way that the user can optimally adjust the floor treatment device to individual surfaces to be treated.

In order to attain this objective, the invention proposes that the user moves the floor treatment device over the surface to be treated during an adjustment process, wherein a limiting device parameter, which is dependent on the nature of the surface and upon its use for the treatment of the surface leads to a predefined fault, is automatically determined during the movement of the floor treatment device, and wherein the parameter range is automatically adjusted based on the determined limiting device parameter in that the limiting device parameter defines a range end of the parameter range.

According to the invention, the user therefore is able to adapt the floor treatment device to the requirements of his household, particularly to the floor types installed therein. It is obviously advantageous to adjust the floor treatment device differently for different types of floor coverings, e.g., for different carpeted floors, different hard floors such as tiled floors, wooden floors, PVC floors, etc. The different adjustments concern different device parameters that are particularly advantageous for a treatment of the respective surface. The surface may be treated, for example, by means of vacuuming, wet or dry wiping, polishing, grinding, waxing or the like. The user therefore can calibrate his personal floor treatment device to the floor coverings installed in his household in order to achieve the best floor treatment possible. This eliminates a disadvantage of the relevant prior art, namely that pre-adjusted parameter ranges on a commercially available floor treatment device basically only make it possible to optimally treat a finite portion of potential floor types. Due to the associated generalization, some floor types possibly are not optimally treated because the user has to choose one of multiple pre-adjustments that, however, may not be optimally adapted to his own floor coverings. According to the inventive method, the user is instructed to move the floor treatment device over the surface to be treated for an adjustment process such that properties of the traversed floor surface or a resulting behavior of the floor treatment device can be respectively determined. This in turn leads to the determination of the optimal parameter range for the surface.

An optimal device parameter for the respective surface can be adjusted by the user between certain range limits for a floor treatment activity, e.g. depending on whether a particularly careful, a particularly intensive, a particularly fast, a particularly thorough cleaning process or the like is desired. An exemplary device parameter that can be adjusted by the user is a suction power of a fan or a rotational speed of a cleaning brush. While the user moves the floor treatment device over the surface to be subsequently treated in the course of an adjustment process, the relevant device parameter of the floor treatment device is either adjusted automatically by a control unit of the floor treatment device or the user is instructed to adjust the device parameter himself by the floor treatment device or a terminal linked thereto. The adjustment of the device parameter preferably takes place automatically starting from a minimum limiting device parameter up to a maximum limiting device parameter, at which a fault occurs that can be detected by the user and/or a detection unit of the floor treatment device. For example, the minimum limiting device parameter may have the value zero, but can also be individually assigned a different value if the value "zero" of the device parameter or another low value causes a fault. In addition, the user may initially predefine rough minimum and maximum limits of the parameter range. For example, the user could already predefine a floor type of the surface to be treated, e.g. that the surface is a floor covering that does not adhere to a substructure. Relatively high values for brush rotational speeds and a moderate value for a volume flow of a suction fan can thereby be directly defined. On a very deep-pile floor or on a fur, for example, the rotational speed of a cleaning brush basically could be set to the value zero and only a volume flow of a suction fan could be adapted. The subsequent process for a precise adjustment of the parameter range then takes place as described herein. In this context, it is furthermore preferred that the limiting device parameter is the value of the device parameter, at which no fault has yet occurred the last time. The occurrence of a fault therefore can be precluded with high probability. A fault should not be interpreted in the strict sense, but rather may be a certain situation that the user defines for a termination of the adjustment process. For example, a "fault" may also be a manual termination of the adjustment process, which basically does not represent a fault in the strict sense. In addition, certain device states may likewise be defined as a fault by the user, e.g., because a noise emission of the floor treatment device or a power consumption of an electric consumer of the floor treatment device exceeds a desired value.

In addition to the above-described adjustment process, the user may also be provided with previously established parameter ranges for certain surface types to be selected in the course of the method, wherein the described adjustment process can then be started beginning at the parameter limits of said parameter ranges. For example, the previously established adjustments may also be stored in a memory in a user-dependent manner such that a specific preselection is made available to a respective user. In any case, the predefined adjustments are not binding, but rather can also be rejected or modified by the user. Predefined adjustments furthermore can be overwritten. It is likewise possible to change or overwrite the parameter ranges adjusted in the course of the inventive adjustment process such that the user has the option of repeating an adjustment process at any time. This is useful, in particular, when the user changes floor coverings in his residence due to wear or the like.

It is particularly proposed that two limiting device parameters, which define the range ends of the same parameter range, are determined in the course of the adjustment process by varying the device parameter from a minimum value, which can still be used without the occurrence of a fault, up to a maximum value, which can still be used without the occurrence of a fault. The variation of the device parameter may either take place in discrete value increments or continuously. If two or more device parameters, which a user usually would like to adjust, are essential for a surface treatment, for example, the adjustment process may take place in such a way that a parameter range for a first device parameter is initially determined while a second device parameter is kept constant. As soon as this parameter range is adjusted, the constant second device parameter can be set to a higher constant value and the first device parameter can in turn be varied in order to determine the relevant range limits. In this way, two or more device parameters can be adapted independently of one another.

It is advantageously proposed that the user adjusts the parameter range by means of an application installed on a terminal that is external to the floor treatment device. In the course of the adjustment process, the application can instruct the user to perform certain actions for varying the respective device parameter himself. Alternatively, the application can control a variation of the respective device parameter on the floor treatment device in a fully automated manner. To this end, the external terminal with the application installed thereon is connected to the floor treatment device via a communication link such as WLAN or Bluetooth. The floor treatment device and the external terminal particularly may be integrated into a home network of the user and communicate with one another via this home network. The application installed on the external terminal preferably provides a user interface, by means of which the user can make manual entries and/or retrieve information, on a touchscreen of the terminal. Previously established basic adjustments for certain floor types may also be offered to the user on a display of the external terminal such that the user can start an adjustment process beginning at predefined rough limit device parameters of a provisionally specified parameter range.

The application advantageously can control a predefined calibration process on the floor treatment device, wherein said calibration process includes the determination of the limiting device parameter to be adjusted on the floor treatment device by successively approximating the controlled device parameter to the limiting device parameter defined by an occurrence of a fault. Consequently, the application directly controls the adjustment process of the floor treatment device and acts upon a control unit of the floor treatment device. Furthermore, the application can also monitor the occurrence of a predefined fault. However, it is also possible that a fault is monitored by an evaluation unit of the floor treatment device itself. The evaluation unit of the floor treatment device can then notify the application of the external terminal of the detected fault such that the application can link the previously adjusted parameter values with the occurrence of the fault, as well as advantageously store the corresponding parameter values.

It is furthermore proposed that the device parameter being adjusted is a suction volume flow of a fan of the floor treatment device, a rotational speed of a rotating floor treatment element, a frequency of an oscillating floor treatment element, a moving speed of the floor treatment device over the surface to be treated and/or a fluid quantity applied on the surface to be treated by the floor treatment device. The aforementioned adjustable device parameters typically are relevant for a treatment quality of certain floor types. If the floor treatment device is a vacuum cleaner, for example, a suction volume flow of a fan and a rotational speed or oscillation frequency of a floor treatment element are particularly relevant device parameters. A quantity of a fluid applied on the surface to be treated or a floor treatment element is particularly relevant for wet wiping devices. In addition, a treatment quality also depends on the moving speed of a self-propelled floor treatment device over the surface to be treated. It is advantageous to keep the moving speed of the floor treatment device over the surface to be treated is slow as possible for floor types requiring particularly intensive treatment such that the exposure time per surface segment is as long as possible.

A fault or multiple faults are predefined as proposed above. These faults serve for specifying range limits of the parameter range to be adjusted. A drop of a suction volume flow of a fan of the floor treatment device below a minimum value, a blockage of a movable floor treatment element, a drop of a moving speed of the floor treatment device below a minimum value, an excessive energy consumption of an electrical consumer of the floor treatment device beyond a maximum value, an excessive moving resistance of the floor treatment device beyond a maximum value, a withdrawal of a floor covering from the surface to be treated, an excessive sound emission of the floor treatment device beyond a maximum value, an excessive degree of moisture of the surface to be treated beyond a maximum value, an excessive degree of moisture of a floor treatment element of the floor treatment device beyond a maximum value and/or a reception of a stop command of a user for terminating the adjustment process particularly may be defined as faults. The preceding list is not conclusive. Other faults may also be predefined within the scope of the invention. Faults typically cause the floor treatment device to function incorrectly or mean a manual termination by a user of the floor treatment device. The occurrence of a thusly defined fault leads an end of the inventive adjustment process. With respect to conventional vacuum cleaners, for example, the adjustment process may be carried out until a fault occurs, wherein this fault means that the maximum values for the volume flow of a suction fan and a rotational speed of a cleaning brush are reached, that a cleaning brush is blocked, e.g., due to an excessive engagement of the cleaning brush into a carpeted floor, that a force to be applied by a user for moving the floor treatment device is excessively high, that a vacuum in the floor treatment device increases excessively, e.g. when an unglued carpet is lifted off a substructure and then completely covers a suction channel of the cleaning device, or that the user manually terminates the adjustment process by pushing a button on the cleaning device or an external terminal.

The fault preferably is defined by a user prior to the adjustment process or may alternatively be predefined by the manufacturer. If faults are already predefined by the manufacturer of the floor treatment device, they are preferably stored in a local memory of the floor treatment device or can be retrieved from a server of the manufacturer by the floor treatment device or an external terminal that is communicatively linked to the floor treatment device.

In addition, the determined limiting device parameter may be stored in a memory of the floor treatment device and/or a memory of the external terminal and/or a memory of an external server. It is furthermore proposed that the adjusted parameter range is assigned to an actuating element of the floor treatment device that can be manually actuated by the user, wherein the user selects a desired value of the device parameter for a floor treatment of the surface within the limits of the pre-adjusted parameter range by actuating the actuating element. The assignments between certain actuating elements of the floor treatment device and the optimal parameter ranges determined by means of the adjustment process may be stored in a memory of the floor treatment device and/or a memory of the external terminal and/or a memory of an external server. An assignment particularly can be associated, for example, with one of multiple selectable stages of an actuating element by an application installed on the external terminal. In this case, each stage can be optimized for a certain floor type such as a hard floor, a short-pile carpeted floor, a deep-pile carpeted floor, etc. Assignments can be deleted again once they have been established and stored, but these assignments advantageously remain available in a memory for future access. In this way, assignments can be adjusted anew once they have been specified. It is particularly advantageous that assignments between actuating elements and predefined parameter ranges are also synchronized by means of a server such that they continue to be available for access by a user, e.g. in the event of a replacement of a mobile terminal.

In addition to the above-described inventive method for adjusting at least one parameter range available on the floor treatment device for treating a surface, the invention also proposes a floor treatment device with a control unit that is designed for carrying out a method of the aforementioned type. Furthermore, a system with a floor treatment device and a terminal that is external to the floor treatment device is proposed, wherein an application designed for controlling such an adjustment process for a parameter range is installed on the external terminal. In order to avoid unnecessary repetitions, we refer to the preceding explanations regarding the inventive method in this respect. The characteristics and advantages described with reference to the inventive method also apply accordingly to the inventive floor treatment device and the inventive system, respectively.

BRIEF DESCRIPTION OF THE DRAWINGS

Other objects and features of the invention will become apparent from the following detailed description considered in connection with the accompanying drawings. It is to be understood, however, that the drawings are designed as an illustration only and not as a definition of the limits of the invention.

In the drawings.

DETAILED DESCRIPTION OF PREFERRED EMBODIMENTS

Figure 1:
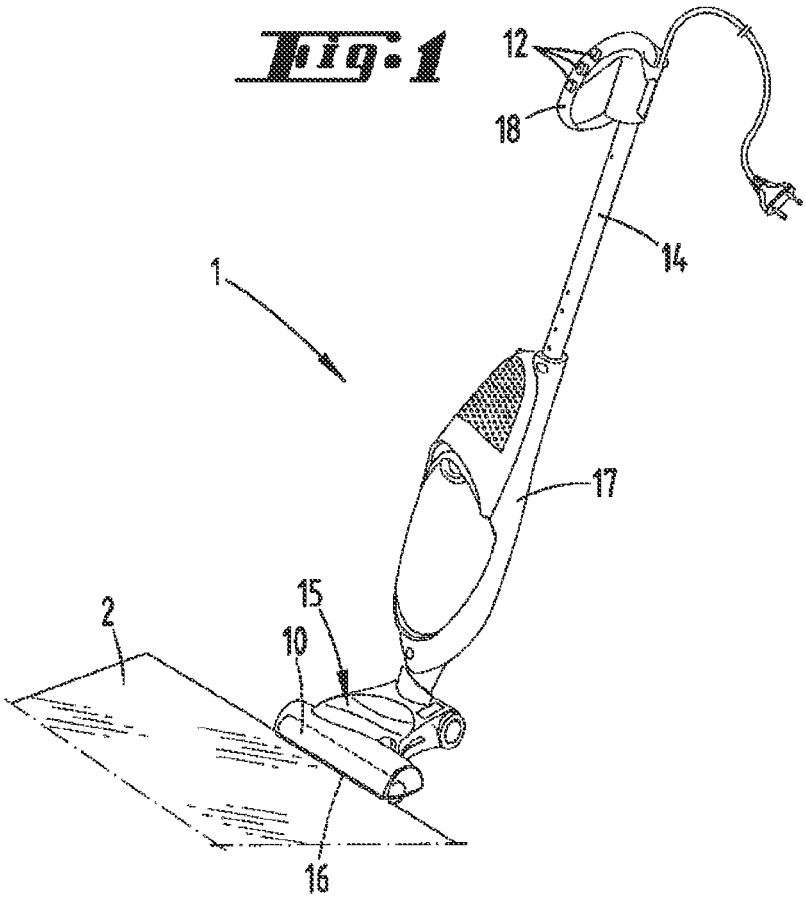
FIG. 1 shows an inventive floor treatment device.

FIG. 1 shows one of a plurality of potential embodiments of an inventive floor treatment device 1. In this case, the floor treatment device 1 is realized in the form of a cleaning device that is manually operated by a user, namely a manually operated vacuum cleaner. However, the invention can also be used in connection with self-propelled floor treatment devices 1. The floor treatment device 1 serves for cleaning different surfaces 2 that may comprise, for example, hard floors and carpeted floors, particularly deep-pile carpeted floors, short-pile carpeted floors, wooden parquet, wooden floorboards, tiles, cork, PVC, etc. The floor treatment device 1 has a base unit 17 containing, for example, a fan, a fan motor and a dust chamber that are not visible in this figure. The base unit 17 is separably connected to an attachment 15 that serves for acting upon the surface 2 to be treated. In this example, the attachment 15 is a suction nozzle with a suction mouth 16 and a floor treatment element 10 assigned to the suction mouth 16. For example, the floor treatment element 10 is a cleaning brush that rotates about an axis, which is essentially oriented parallel to the surface 2. Furthermore, a shaft 14 with a handle 18 extends from the base unit 17—on the opposite side of the attachment 15—and enables a user of the floor treatment device 1 to guide the floor treatment device 1 over the surface 2 to be treated in the form of a conventional forward and backward movement. The shaft 14 is advantageously designed in a telescopic manner such that the user can adapt its length to his body size in order to comfortably handle the floor treatment device 1. The handle 18 has a plurality of actuating elements 12, which in this example are designed in the form of pushbuttons. Different types of actuating elements 12 such as sliding switches, rotary switches, toggle switches or the like may be alternatively provided. The user can adjust a desired mode of the floor treatment device 1 for treating the surface 2 by actuating the actuating elements 12. For example, one mode may be an energy-saving eco-mode, in which the fan motor is operated in the most energy-saving manner possible. Another exemplary mode may be an intensive mode suitable for also removing stubborn dirt accumulations from the surface 2. It would furthermore be possible, for example, to provide a rapid mode that cleans the floor surface 2 as quickly as possible. In this case, each mode is characterized by an available parameter range 3 with a plurality of different values of a device parameter 4, wherein said device parameters concern, for example, a power consumption of the fan motor, a rotational speed of the floor treatment element 10, an adjustment of the sealing elements in the region of the suction mouth 16 of the floor treatment device 1, etc. For example, the parameter range 3 may contain low and high values for a rotational speed of the actuating element 12, which the user can select for a floor treatment. The adjustments of the respective mode, particularly the device parameters 4, preferably are stored in a local memory of the floor treatment device 1, wherein said adjustments are retrieved from a memory upon actuation of an actuating element 12 and used by a control unit 19 of the floor treatment device 1 which is in the form of a computer processor configured for controlling the corresponding units of the floor treatment device 1, e.g. the fan motor or a driving motor for the floor treatment element 10. The modes may furthermore be optimized for certain floor types of the surface 2 to be treated. For example, an eco-mode may be optimized for the treatment of a hard floor whereas an intensive mode may be optimized for the treatment of a carpeted floor. Furthermore, the floor treatment device 1 may also have actuating elements 12 that control different combinations such as carpet mode eco, carpet mode intensive, hard floor eco, hard floor intensive, etc. The different modes are usually predefined by the manufacturer of the floor treatment device 1 and in floor treatment devices 1 according to the prior art stored in a memory of the floor treatment device 1. The invention, in contrast, proposes an alternative that is described in greater detail below.

Figure 2:
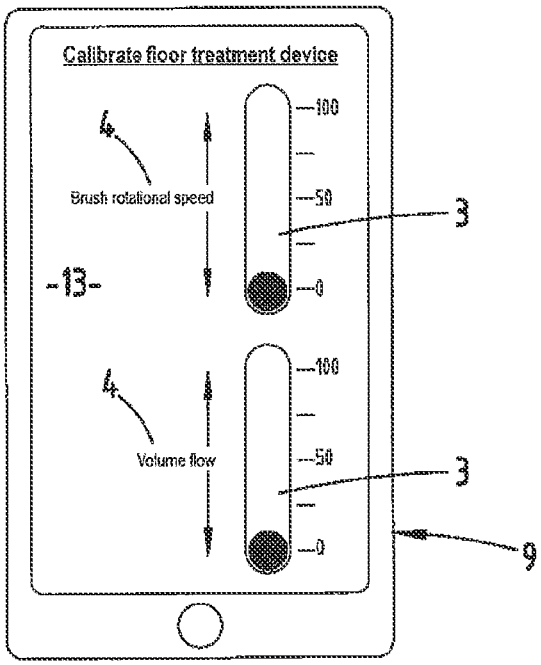
FIG. 2 shows an external terminal with an application installed thereon.
Figure 4:
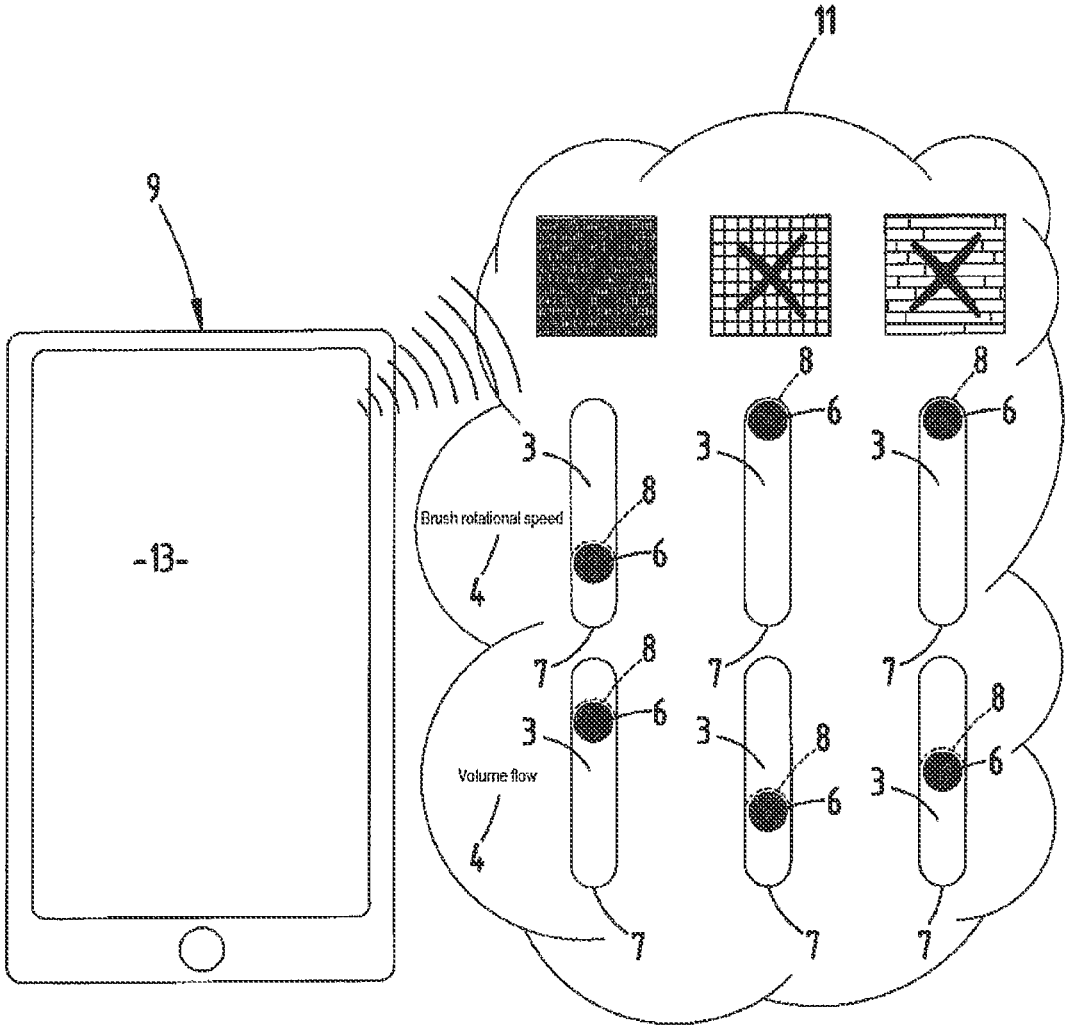
FIG. 4 shows a communication between the external terminal and an external server.
Figure 5:
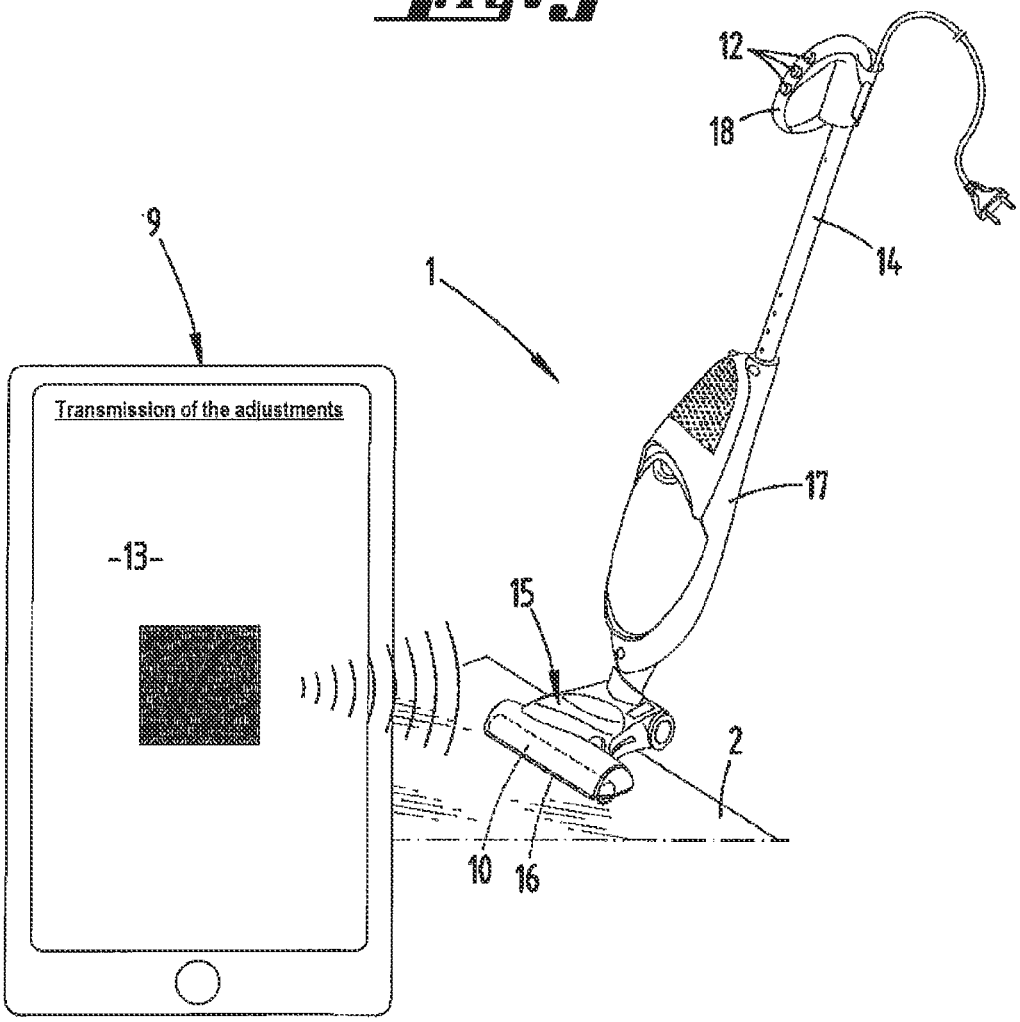
FIG. 5 shows a transmission of adjustments from the external terminal to the floor treatment device.

FIG. 2 shows an external terminal 9, which in this example is a mobile telephone. However, the external terminal 9 may also be a different external terminal 9, preferably a mobile terminal. It would also be possible, in particular, to use a terminal 9 in the form of a tablet computer, a laptop or the like. The external terminal 9 preferably has a conventional display 13, which is preferably designed in the form of a touchscreen and enables a user to receive information, as well as to make entries. The external terminal 9 communicates with the floor treatment device 1 in order to carry out an inventive method. To this end, the floor treatment device 1 and the external terminal 9 are equipped with communication modules, e.g. WLAN modules, Bluetooth modules, etc. It is particularly preferred that a communication module of the floor treatment device 1 and a communication module of the external terminal 9 are incorporated into a home network of a user. Furthermore, an application for carrying out the steps of the inventive method is installed on the external terminal 9. In addition, a server 11 (see, e.g., FIG. 4) preferably is also incorporated into the communication network such that data concerning adjustments of the floor treatment device 1 can be stored in the server 1 and retrieved by other subscribers of the home network, particularly the floor treatment device 1 and the external terminal 9.

The user can optimize his floor treatment device 1 for the individual floor coverings of the surfaces 2 to be cleaned in his household by using the application installed on the external terminal 9. To this end, device parameters 4 of the floor treatment device 1 used for the floor treatment of the surfaces 2 are adjusted, i.e. calibrated, to the individual properties of the surfaces 2 in the household of the user. However, the floor treatment device 1 can be analogously calibrated to surfaces 2 that do not form part of a household environment, but rather a commercial environment such as a store, an office, a storage building, etc. The function of the invention remains the same.

The application installed on the external terminal 9 enables the user to adjust his floor treatment device 1 to his individual surfaces 2 in a few simple steps and to thereby achieve an optimal floor treatment result. In the case of a cleaning device, an optimal floor treatment result may be interpreted, for example, based on a quantity of particles picked up by the floor treatment device 1. As a result of the invention, the user furthermore experiences optimal handling of the floor treatment device 1 and all components of the floor treatment device 1 function in a trouble-free manner. This includes, for example, that floor treatment element 10 such as the rotating cleaning brush does not jam, that the floor treatment device 1 can be moved over the surface 2 to be treated with a low expenditure of force, that carpets lying loosely on a substructure are not lifted off the substructure and the like. To this end, the user initially has to start the application on his external terminal 9 and carry out displayed calibration steps, which serve for adjusting at least one parameter range 3 of a device parameter 4 of the floor treatment device 1 available on his floor treatment device 1. The example according to FIG. 2 shows only two different adjustable device parameters 4, namely a rotational speed of the brush (floor treatment element 10) and a volume flow that can be generated by a fan of the floor treatment device 1. After starting the application, the user preferably is asked to move the floor treatment device 1 over the respective surface 2, for which the floor treatment device 1 should be optimally adjusted. The movement of the floor treatment device 1 during the calibration process makes it possible to take into account a dynamic load of the floor treatment device 1, which subsequently also occurs analogously during the use of the floor treatment device 1 for an actual floor treatment of this surface 2. The application then controls a calibration process on the floor treatment device 1 in a fully automated manner, wherein said calibration process includes a variation of the rotational speed of the floor treatment element 10 and the volume flow of the fan, preferably from a lower value of the respective device parameter 4 up to a higher value of the device parameter 4, in discrete increments or alternatively also continuously. This may be carried out, for example, in such a way that only the volume flow is initially varied while a lowest rotational speed of the floor treatment element 10 is kept constant. The rotational speed of the floor treatment element 10 can then be adjusted to a higher value than in the preceding step and the volume flow can subsequently be varied again from a lower value up to a higher value, namely while the rotational speed of the floor treatment element 10 is kept constant, in successive steps. For example, the slowest rotational speed of the floor treatment element 10, at which the calibration process is started, may have the value zero. However, it is alternatively also possible that the user himself defines a starting rotational speed, at which the adjustment process for the respective parameter range 3 of the volume flow and also the rotational speed of the floor treatment element 10 is started. Furthermore, rough minimum or maximum limiting device parameters 5, 6 already may be provisionally specified for the adjustment process beforehand and retrieved by the user in the application. For example, such a pre-adjustment can distinguish between hard floors and carpeted floors such that the adjustment process for the parameter range 3 of the device parameter 4 starts directly, for example, in regions that are sensible for a hard floor or in regions that are sensible for a carpeted floor. This makes it possible to altogether shorten the calibration process. The pre-adjustments may be stored in the application or also on a server 11 accessed by the application. Furthermore, such pre-adjustments may also be defined in dependence on countries and/or markets such that a floor treatment device 1 used, for example, in Asia has different sensible calibration start parameters and calibration end parameters than a floor treatment device used, for example, in Europe. The stored pre-adjustments preferably can also be deleted, modified or the like by the user with the aid of the application.

Furthermore, so-called faults are stored in the application by the manufacturer of the floor treatment device 1 or also by the user, wherein said faults should lead to the termination of an adjustment step during the calibration. Due to the definition of such a fault or multiple faults, the user can only operate the floor treatment device 1 in a parameter range 3 of the respective device parameter 4, which allows a trouble-free and successful treatment of the surface 2, at a later time, i.e. after the calibration is completed. In the present example, a fault may be defined as a blockage of the rotating floor treatment element 10 or the occurrence of a maximum force to be exerted by the user in order to move the floor treatment device 1 over the surface 2. Other faults may be characterized, for example, by a maximum value for the volume flow, a maximum value for the vacuum at the suction mouth 16, a withdrawal of the floor covering from a substructure, etc. However, a fault may also be a manual termination of the calibration process by the user although this does not represent a fault in the strict sense. For example, the user can terminate the calibration process for the respective device parameter 4 with a button on the floor treatment device 1 or with an entry on the display 13 of the external terminal 9. If a predefined fault for the usable parameter range 3 of the device parameter 4 is detected during the adjustment process, the calibration step is terminated and the last adjustment prior to the occurrence of the fault preferably is used as limiting device parameter 5, 6. This limiting device parameter 5, 6, which still allows an optimal treatment of the surface 2, respectively defines a lower range end 7 or an upper range end 8 of the parameter range 3 that is subsequently available to the user during the use of the floor treatment device 1. The application furthermore enables the user to select the actuating element 12 on the floor treatment device 1, by means of which the device parameter 4 should be controllable.

Figure 3:
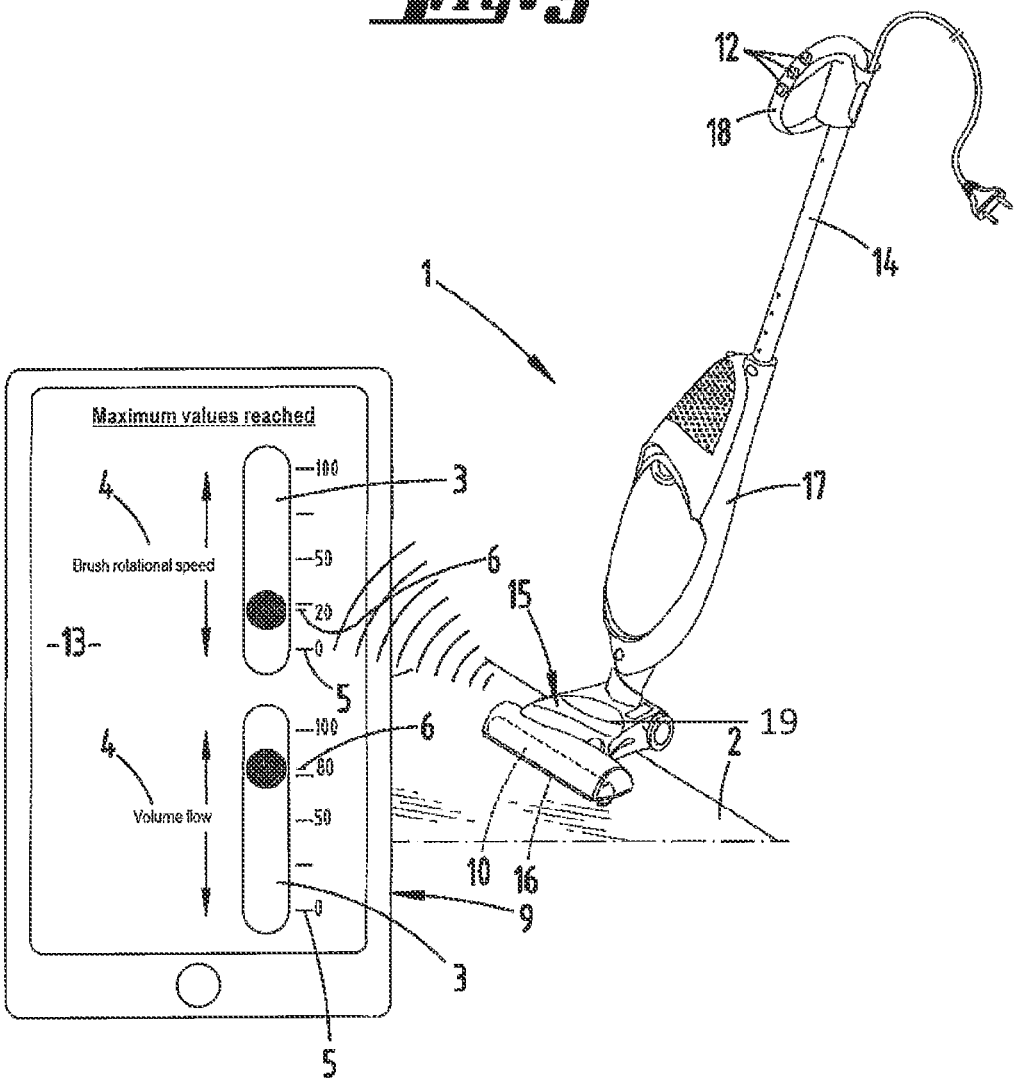
FIG. 3 shows a communication between the external terminal and the floor treatment device.

In FIG. 2, the user starts the calibration process for the floor treatment device 1, for example, at the lower limiting device parameter 5 "zero," which represents the lower range end 7 of the parameter ranges 3 for the device parameters 4 "brush rotational speed" and "volume flow." The calibration of the parameter ranges 3 for "brush rotational speed" and "volume flow" then takes place as described above. According to FIG. 3, a "fault" occurs, for example, at a rotational speed that in this case corresponds to 20 percent of a highest possible rotational speed of the floor treatment element 10. This rotational speed is then stored as the upper limiting device parameter 6 for the rotational speed of the floor treatment element 10. With respect to the volume flow of the fan, a fault likewise occurs at 80 percent of the highest possible volume flow of the floor treatment device 1. This value at 80 percent is then stored as the upper limiting device parameter 6 for the volume flow. The stored values for the lower limiting device parameters 5 and the upper limiting device parameters 6 of the device parameters 4 "brush rotational speed" and "volume flow" are subsequently transmitted to the floor treatment device 1 and the external server 11 (see FIG. 4) as shown. The stored adjustments advantageously are stored permanently in the floor treatment device 1, as well as the external terminal 9 and the server 11, but can also be deleted or modified by the user. In this way, the user can once again retrieve stored adjustments from the server 11, e.g., when the user replaces his external terminal 9. The user can then use the stored adjustments for the parameter ranges 3, which can be used by means of the assigned actuating elements 12, for achieving an optimal floor treatment result for his individual surfaces 2.

The user can also adjust certain combinations of base units 17 and attachments 15 to individual surfaces 2 just as described above. A person skilled in the art knows that the adjusted device parameters 4 may not only be a rotational speed of a floor treatment element 10 or a volume flow of a fan, but rather also any other type of device parameter 4 such as a frequency of an oscillating floor treatment element 10, a moving speed of a self-propelled floor treatment device 1 traveling over the surface 2, a fluid quantity applied on the surface 2 to be treated or on a floor treatment element 10 of the floor treatment device 1, etc. Furthermore, faults other than those mentioned above may also be defined.

Although only a few embodiments of the present invention have been shown and described, it is to be understood that many changes and modifications may be made thereunto without departing from the spirit and scope of the invention.

LIST OF REFERENCE SYMBOLS

1 Floor treatment device
2 Surface
3 Parameter range
4 Device parameter
5 Limiting device parameter
6 Limiting device parameter
7 Range end
8 Range end
9 External terminal
10 Floor treatment element
11 Server
12 Actuating element
13 Display
14 Shaft
15 Attachment
16 Suction mouth
17 Base unit
18 Handle
19 Control unit

What is claimed is:

1. A method for adjusting at least one parameter range of a device parameter of a floor treatment device for treating a surface, wherein said at least one parameter range is available on the floor treatment device and depends on a floor type of the surface to be treated, wherein the at least one parameter range has parameter limits, and a user is restricted to selection of a device parameter within the at least one parameter range, the method comprising the steps:

selecting by the user the device parameter by means of an actuating element, which can be adjusted between a minimum value and a maximum value for a respective device parameter, wherein the device parameter comprises one of a power consumption of a fan motor of the floor treatment device, a rotational speed of a floor treatment element, an adjustment of sealing elements in a region of a suction mouth of the floor treatment device, a frequency of an oscillating floor treatment element, a moving speed of a self-propelled floor treatment device, a fluid quantity applied on the surface to be treated or on a floor treatment element of the floor treatment device, moving by the user the floor treatment device over the surface to be treated during an adjustment process, wherein the user is instructed on a display of an external terminal to move the floor treatment device over the surface to be treated for the adjustment process for adjusting the at least one parameter range in order to determine properties of the surface to be treated and a resulting device parameter of the floor treatment device, automatically adjusting the selected device parameter by a control unit of the floor treatment device, wherein the control unit comprises a processor programmed to adjust the device parameter of the floor treatment device, wherein the adjustment of the device parameter comprises automatically operating the floor treatment device starting at a minimum limiting device parameter, which defines a lower end of the parameter range, up to a maximum limiting device parameter, which defines an upper end of the parameter range, wherein the floor treatment device is operated until a fault occurs that causes the floor treatment device to function incorrectly, said fault being detected by a detection unit of the floor treatment device, wherein the minimum limiting device parameter or the maximum limiting device parameter is defined after an occurrence of the fault as the minimum limiting device parameter or the maximum limiting device parameter that allows optimal treatment of the surface without the fault, and automatically adjusting the at least one parameter range based on the minimum and the maximum limiting device parameters.

2. The method according to claim 1, wherein the minimum limiting device parameter has a value of zero.

3. The method according to claim 1, wherein the minimum limiting device parameter can be individually specified by the user.

4. The method according to claim 1, wherein the user is provided with previously established parameter ranges to be selected for certain surface types of a surface to be treated, wherein the adjustment process can be started from the parameter limits of these previously established parameter ranges.

5. The method according to claim 1, wherein the user predefines minimum and maximum limiting parameter values for the adjustment process.

6. The method according to claim 1, wherein the user predefines a floor type of the surface to be treated for the adjustment process.

7. The method according to claim 1, wherein the fault is defined by the user as a device parameter reached in a course of operating the floor treatment device up to the maximum limiting device parameter as a trigger for a termination of the adjustment process.

8. The method according to claim 1, wherein the fault is a manual termination of the adjustment process, a predefined device state of the floor treatment device, a predefined noise emission of the floor treatment device or an excessive power consumption of an electric consumer of the floor treatment device beyond a defined value.

* * * * *